US008839496B2

(12) United States Patent
Link et al.

(10) Patent No.: US 8,839,496 B2
(45) Date of Patent: Sep. 23, 2014

(54) FLAME BLOCKING LINER MATERIALS

(71) Applicant: Freudenberg Nonwovens, L.P., Durham, NC (US)

(72) Inventors: Eberhard Link, Raleigh, NC (US); James Frasch, Hollis, NH (US)

(73) Assignee: Freudenberg Nonwovens, L.P., Durham, NC (US)

( * ) Notice: Subject to any disclaimer, the term of this patent is extended or adjusted under 35 U.S.C. 154(b) by 0 days.

(21) Appl. No.: 13/682,104

(22) Filed: Nov. 20, 2012

(65) Prior Publication Data

US 2013/0081238 A1 Apr. 4, 2013

Related U.S. Application Data

(60) Division of application No. 12/430,638, filed on Apr. 27, 2009, now abandoned, which is a continuation-in-part of application No. 10/914,719, filed on Aug. 9, 2004, now abandoned, which is a continuation-in-part of application No. 10/262,133, filed on Oct. 1, 2002, now abandoned.

(51) Int. Cl.
*D04H 1/46* (2012.01)
*D04H 1/42* (2012.01)
*D04H 13/00* (2006.01)

(52) U.S. Cl.
CPC ..... *D04H 1/46* (2013.01); *D04H 13/003* (2013.01); *D04H 1/42* (2013.01)
USPC ..... 28/107

(58) Field of Classification Search
USPC ..... 28/107, 112, 113, 114; 442/402, 403, 442/405, 407, 414
See application file for complete search history.

(56) References Cited

U.S. PATENT DOCUMENTS

| | | | |
|---|---|---|---|
| 3,955,032 | A | 5/1976 | Mischutin |
| 4,026,808 | A | 5/1977 | Duffy |
| 4,600,606 | A | 7/1986 | Mischutin |
| 4,702,861 | A | 10/1987 | Farnum |
| 4,776,854 | A | 10/1988 | Ogawa et al. |

(Continued)

FOREIGN PATENT DOCUMENTS

| | | |
|---|---|---|
| GB | 2245606 | 1/1992 |
| WO | 03/023108 | 3/2003 |
| WO | 2004/061178 | 7/2004 |
| WO | 2004/088023 | 10/2004 |

OTHER PUBLICATIONS

Kirk-Othmer, "Encyclopedia of Chemical Technology" "Encyclopedia of Chemical Technology", 3rd Ed., vol. 16, p. 1.

(Continued)

*Primary Examiner* — Amy Vanatta
(74) *Attorney, Agent, or Firm* — Grossman, Tucker, Perreault & Pfleger, PLLC

(57) ABSTRACT

A fire blocking non-woven textile containing a first carded web of char-forming fibers containing aramid or melamine/formaldehyde fiber and a second carded web of oxygen-depleting fibers comprising a blend of polyacrylonitrile copolymer with a halogen comonomer and a polyester polymer. The webs may be needled-punched or thermally bonded and remain as separate layers separating the action of the char forming and oxygen depleting layers to optimize char strength, provide a light weight product, which may satisfy 16 CFR 1633 at thicknesses of up to 3.0 mm.

6 Claims, 2 Drawing Sheets

(56) References Cited

U.S. PATENT DOCUMENTS

| | | | | |
|---|---|---|---|---|
| 5,051,110 | A | 9/1991 | Borrell et al. | |
| 5,051,111 | A | 9/1991 | Anceschi et al. | |
| 5,534,325 | A | 7/1996 | Joerder et al. | |
| 5,540,980 | A | 7/1996 | Tolbert et al. | |
| 5,569,528 | A | 10/1996 | Van Der Loo et al. | |
| 5,578,368 | A | 11/1996 | Forsten et al. | |
| 5,645,926 | A | 7/1997 | Horrocks et al. | |
| 5,662,978 | A | 9/1997 | Brown et al. | |
| 5,695,528 | A | 12/1997 | Komori et al. | |
| 5,766,754 | A | 6/1998 | Fleck et al. | |
| 5,935,882 | A | 8/1999 | Fujita et al. | |
| 6,102,128 | A | 8/2000 | Bridgeman | |
| 6,287,690 | B1 | 9/2001 | Land | |
| 6,309,565 | B1 | 10/2001 | Stowell et al. | |
| 6,489,256 | B1 | 12/2002 | Sammakia et al. | |
| 6,553,749 | B2 | 4/2003 | Land et al. | |
| 6,596,658 | B1 | 7/2003 | Putnam et al. | |
| 6,617,382 | B1 | 9/2003 | Pirig et al. | |
| 6,670,001 | B2 | 12/2003 | Kohsaka | |
| 6,689,840 | B1 | 2/2004 | Eustace et al. | |
| 6,696,374 | B2 | 2/2004 | Bridgeman et al. | |
| 6,718,583 | B1 | 4/2004 | Diaz | |
| 6,719,810 | B1 | 4/2004 | Kelly et al. | |
| 6,723,378 | B2 | 4/2004 | Hrubesh et al. | |
| 6,737,456 | B2 | 5/2004 | Bar-Yakov et al. | |
| 6,759,127 | B1 | 7/2004 | Smith, III et al. | |
| 6,764,971 | B2 | 7/2004 | Kelly et al. | |
| 6,787,228 | B2 | 9/2004 | Campbell et al. | |
| 6,790,795 | B2 | 9/2004 | Erb, Jr. et al. | |
| 6,800,367 | B2 | 10/2004 | Hanyon et al. | |
| 6,823,548 | B2 | 11/2004 | Murphy et al. | |
| 6,850,681 | B2 | 2/2005 | Lepont et al. | |
| 6,858,550 | B2 | 2/2005 | Ahluwalia | |
| 6,866,928 | B2 | 3/2005 | Narum et al. | |
| 6,867,154 | B1 | 3/2005 | Lunsford et al. | |
| 6,875,805 | B2 | 4/2005 | Eustace et al. | |
| 6,889,494 | B2 | 5/2005 | Tanahashi et al. | |
| 6,890,637 | B2 | 5/2005 | Baker | |
| 6,890,638 | B2 | 5/2005 | Nguyen | |
| 6,954,956 | B1 | 10/2005 | Diaz | |
| 7,005,089 | B2 | 2/2006 | Takeuchi et al. | |
| 7,013,496 | B2 | 3/2006 | Dunn | |
| 7,087,300 | B2 | 8/2006 | Hanyon et al. | |
| 7,091,139 | B2 | 8/2006 | Nobuto et al. | |
| 7,229,937 | B2 | 6/2007 | Bascom et al. | |
| 7,259,117 | B2 | 8/2007 | Mater et al. | |
| 2003/0021978 | A1 | 1/2003 | Wolf | |
| 2003/0041626 | A1 | 3/2003 | Yang et al. | |
| 2003/0171055 | A1 | 9/2003 | Endo et al. | |
| 2003/0176125 | A1 | 9/2003 | Ahluwalia | |
| 2003/0224679 | A1 | 12/2003 | Ahluwalia | |
| 2003/0228460 | A1 | 12/2003 | Ahluwalia | |
| 2004/0001978 | A1 | 1/2004 | Bader et al. | |
| 2004/0028958 | A1 | 2/2004 | Assink et al. | |
| 2004/0029473 | A1 | 2/2004 | McKee et al. | |
| 2004/0062912 | A1* | 4/2004 | Mason et al. | 428/139 |
| 2004/0097156 | A1 | 5/2004 | McGuire et al. | |
| 2004/0102112 | A1 | 5/2004 | McGuire et al. | |
| 2004/0106347 | A1 | 6/2004 | McGuire et al. | |
| 2004/0166353 | A1 | 8/2004 | Owens, Jr. et al. | |
| 2004/0198125 | A1* | 10/2004 | Mater et al. | 442/394 |
| 2004/0226100 | A1 | 11/2004 | Small, Jr. et al. | |
| 2005/0014435 | A1 | 1/2005 | Maini | |
| 2005/0026528 | A1 | 2/2005 | Forsten et al. | |
| 2005/0095936 | A1 | 5/2005 | Jones et al. | |
| 2005/0170732 | A1 | 8/2005 | Knoff | |
| 2005/0197028 | A1 | 9/2005 | Hartgrove et al. | |
| 2005/0210584 | A1 | 9/2005 | Lim et al. | |
| 2005/0215142 | A1 | 9/2005 | Bascom et al. | |
| 2005/0227558 | A1* | 10/2005 | Small et al. | 442/136 |
| 2005/0245163 | A1 | 11/2005 | Aneja et al. | |
| 2005/0245164 | A1 | 11/2005 | Aneja et al. | |
| 2006/0030227 | A1 | 2/2006 | Hairston et al. | |
| 2006/0093870 | A1* | 5/2006 | Davis | 428/920 |
| 2006/0116043 | A1 | 6/2006 | Hope et al. | |
| 2007/0066175 | A1* | 3/2007 | Wolf et al. | 442/415 |
| 2008/0313873 | A1* | 12/2008 | Link et al. | 28/108 |

OTHER PUBLICATIONS

Fibersource Home, "Lyocell Fiber-Lyocell Staple Fiber", available at www.afma.org/f-tutur/lyocell.ftm, retrieved on Jul. 28, 2004, 1pg.

Fibersource Home, "Rayon Fiber-Rayon Staple Fiber, Rayon Textile Filament Fiber, Rayon Industrial Filament Fiber," available at www.fibersource.com/f-tutor/rayon.htm, retrieved on Aug. 8, 2004. 4 pages.

Linda H. Heaton, Ph.D., "What is Forestry? Lyocell" UK Cooperative Extension service, University of Kentucky College of Agriculture, 2 pgs.

Joyce Ann Smith, PhD. The Ohio State University Extension Fact Sheet, Consumer and Textile Services "Lyocell-One Fiber, Many Faces", available at htpp:/lohioline.osu.edu/hyg-fact/500/5572.html,retrieved on Jul. 28, 2004, 4pgs.

"Celbond", www.invista.com, 2005.

"Technical Information—VISIL", Sateri Oy, Finland, 10 pages. Feb. 2000.

"Product Sales Description: Basofil Fiber Merge 77", author unknown. 6 pages. Jan. 2001.

International Search Report and Written Opinion of corresponding PCTJUS05J28257 filed Aug. 8, 2005. Date mailed Jul. 31, 2006. 8 pages.

International Search Report and Written Opinion of counterpart PCTJUS03J30750 filed Sep. 30, 2003. Date mailed Feb. 19, 2004. 4 pages.

* cited by examiner

FLAME BLOCKING LINER MATERIALS

CROSS-REFERENCE TO RELATED APPLICATIONS

This application is divisional of U.S. application Ser. No. 12/430,638 filed Apr. 27, 2009, which is a continuation-in-part of U.S. application Ser. No. 10/914,719 filed Aug. 9, 2004, which is a continuation-in-part of U.S. application Ser. No. 10/262,133, filed Oct. 1, 2002, the disclosures of which are incorporated herein by reference.

FIELD OF THE INVENTION

This invention relates to fire resistant needle punched materials and to their methods of preparation. The invention has particular utility in the formation of fire blocking fabric as a liner under upholstery fabric and mattress ticking. The invention also has utility for the production of fire resistant vertical lapped batting material.

BACKGROUND OF THE INVENTION

As noted in U.S. Pat. No. 6,287,690, it is well known in the textile industry to produce fire resistant fabrics for use as upholstery, mattress ticking, panel fabric, etc., using yarn formed of natural or synthetic fibers, and then treating the fabric with fire retardant chemicals. Conventional fire retarding chemicals include halogen-based and/or phosphorous-based chemicals. Such treated fabrics reportedly are heavier than similar types of non-fire retardant fabrics, and are said to have a more limited wear life.

The incidence of mattress fires in the United States is such that there have been efforts to establish standards for testing open flame flammability of mattresses. California, e.g., has enacted regulations in 2001 which requires all mattresses to be sold effective January 2005 to meet the performance requirements of California Technical Bulletin 603, now replaced by 16 CFR 1633. This is a consequence, among other things, of the fact that the foam used in mattresses can be a source of fuel which can be ignited and quickly engulf the mattress in flames.

Not surprisingly, therefore, one can uncover numerous disclosures aimed at modifying the burning characteristics of fiber materials. For example, in U.S. Pat. No. 4,600,606 a method of flame retarding textile and related fibrous materials is reported, which relies upon the use of a water-insoluble, non-phosphorous containing brominated aromatic or cycloaliphatic compounds along with a metal oxide. U.S. Pat. No. 4,026,808 reports on the use of a phosphorous containing N-hydroxy-methyl amide and tetrakis(hydroxymethyl) phosphonium chloride. U.S. Pat. No. 3,955,032 confirms the use of chlorinated-cyclopentadieno compounds, chlorobrominated-cyclpentadieno compounds, either alone or in combination with metal oxides.

U.S. Pat. No. 4,702,861 describes a flame retardant composition for application as an aqueous working dispersion onto surfaces of combustible materials. Upon exposure to elevated temperatures and/or flame, the formulation reportedly creates a substantially continuous protective film generally encapsulating and/or enveloping the surface of the article onto which it is applied. The film-forming materials are based upon an aqueous latex dispersion of polyvinylchloride-acrylic copolymer together with certain other film-forming and viscosity controlling components.

Other disclosures which offer additional background information include U.S. Pat. No. 4,776,854 entitled "Method for Flameproofing Cellulosic Fibrous Materials"; U.S. Pat. No. 5,051,111 entitled "Fibrous Material"; U.S. Pat. No. 5,569,528 entitled "Treating Agent for Cellulosic Textile Material and Process for Treating Cellulosic Textile Material"; and U.S. Pat. No. 6,309,565 entitled "Formaldehyde-Free Flame Retardant Treatment for Cellulose-Containing Materials".

It is also worth mentioning that within the various efforts to provide flame resistant fabric products, various polymers themselves have emerged as substrates for use as flame resistant fibers. For example, melamine and melamine/formaldehyde based resinous fibers are said to display desirable heat stability, solvent resistance, low flammability and high-wear characteristics. One form of melamine/formaldehyde fiber is marketed under the tradename Basofil™. In addition, the aromatic polyamide family or aramids reportedly have high strength, toughness, and thermal stability. Aramid fibers are marketed under the tradenames Nomex™ and Kevlar™.

Furthermore, acrylic fibers are well-known in the synthetic fiber and fabric industries, as are the modified acrylic fibers (modacrylic). Such modacrylics are relatively inexpensive, and have been used in various blends with the fibers noted above to provide fire-resistant fabric material. One particular modacrylic fiber is sold under the tradename Kanecaron™ Protex, which is available from Kaneka Corporation, Japan.

In addition, flame retardant viscose fibers have become available, and one particular viscose fiber is sold under the tradename Visil™. More specifically, Visil™ is said to comprise a silicic acid containing viscose, with a limiting oxygen index (i.e., the minimum concentration of oxygen necessary to support combustion) in the range of 27-35, depending upon a particular textile construction.

Finally, it is worth noting that various manufacturers have produced and sold fire-resistant fabric material. They are as follows: 1. E.R. Carpenter's "Fire Stop™" which relies upon Basofil™/modacrylic high loft batting; 2. Chiquola Industrial Fabric's "FireGuard™" which relies upon core spun flame retardant yarns into woven or knit form; 3. ChemTick Coated Fabrics "Flame Safe™" which relies upon core spun yarn in woven configuration with flame retardant treatment; 4. Elk Corporation's "VersaShield™" which relies upon a woven fiberglass base with a soft foam like coating on one side; 5. Jones Fiber Products, Inc.'s "T-Bond™" which relates to a flame retardant treatment of cotton batting; 6. Legett & Platt's "Pyro-Gon™" which is a batting of a blend of Pyron (panox) fibers with other fibers; 7. MLM, LLC's "Allesandra" which is a core spun flame retardant yarn in woven form; 8. Tex Tech's various blends of Basofil™ and Nomex™, Kevlar™ and PBI in the form of needlepunched felts; and 9. Ventex's "Integrity 30™", SpunGold™ and AKTIV™ which collectively relate to various products of knits and nonwoven battings that may include Basofil™, Panox, Kevlar™ or Nomex™.

It is therefore an object of the present invention to expand upon the technology directed at the manufacture of flame retardant materials, and develop a fire resistant needle punched material that can serve, among other things, as a protective liner material. More specifically, it is an object of the present invention to develop new types of needle punched materials that rely upon a foundation component of a modified acrylic type fiber that is based upon a copolymer of polyacrylonitrile and a halogen based monomer to provide an inexpensive fire blocking composition.

It is also an object of the present invention to provide a fire-resistant material which relies upon a needle punched non-woven manufacture of two principal components, wherein one component is selected to provide non-burning characteristics, and a second component is selected to support and maintain the first component in place during burning as well as to provide non-burning characteristics, thereby resulting in a synergistic composition that reduces the burn rate in a given liner application.

SUMMARY OF THE INVENTION

In a first embodiment, the present invention comprises a fire blocking non-woven needlepunched textile structure, comprising a first fiber component containing polyacrylonitrile copolymer with a halogen containing monomer and a second fiber component, wherein said second fiber component supports said first fiber component during burning, optionally including inorganic filler as a coating for said first and second fiber components.

In a second embodiment, the invention herein comprises a fire blocking non-woven textile structure, in the form of vertical lapped batting, comprising a first fiber component containing polyacrylonitrile copolymer with a halogen containing monomer and a second fiber component, wherein said second fiber component comprises a viscose fiber containing silicic acid and/or a melamine-formaldehyde polymer, and a third fiber component comprising a binder fiber having the capability to melt bond said first and second components wherein said first and second components are melt bonded together by said binder fiber.

In a third embodiment, the invention herein comprises a fire blocking non-woven textile structure, comprising a first fiber component containing polyacrylonitrile copolymer with a halogen containing monomer and a second fiber component such as a viscose fiber containing silicic acid and/or a regenerated cellulose fiber and a third fiber component such as an aramid fiber or a melamine/formaldehyde fiber. Optionally, one may also include a polyester fiber component, such as an aromatic polyester such as poly(ethylene terephthalate) (PET) which can also be employed to replace the aramid or melamine/formaldehyde component. In addition, optionally, one may also employ a binder fiber having the ability to melt bond with all the fiber components.

In a fourth embodiment, the invention herein comprises a fire blocking non-woven textile structure that is strategically located on a foam-containing article to provide fire blocking performance. Accordingly, the invention comprises a fire blocking non-woven textile cover for a foam containing article such as a mattress wherein the mattress contains horizontal and vertical sections, and wherein said cover includes a horizontal section comprising a fire blocking non-woven textile structure made from polyacrylonitrile copolymer with a halogen containing monomer and a second fiber component. The second fiber component supports said first fiber component during burning, and the non-woven textile structure for such horizontal section of the mattress optionally includes inorganic filler as a coating or saturant for the first and second fiber components. The second fiber component may include a viscose fiber containing silicic acid and/or a melamine/formaldehyde polymer and/or a polyester component. The cover also includes a vertical cover section for the vertical sections of the mattress and comprises a first fiber component containing polyacrylonitrile copolymer with a halogen containing monomer and a second fiber component such as a viscose fiber containing silicic acid and/or a melamine formaldehyde polymer and a third fiber component such as an aramid fiber.

In a fifth embodiment, the present invention is directed at a fire blocking non-woven textile structure, comprising a needle-punched web including an aramid fiber, wherein said needle punched web including an aramid fiber is attached or needle-punched with a spunbond or melt blown or spunbond/melt blown web material.

In a sixth embodiment the present invention is directed at a fire blocking non-woven needle-punched textile structure, comprising a first carded web including an aramid and/or melamine/formaldehyde fiber and a second carded web comprising a blend of polyacrylonitrile copolymer with a halogen comonomer and a polyester polymer, wherein said first carded web including aramide and/or melamine/formaldehyde fiber is needle punched with said second carded web of said blend. The aramid and/or melamine/formaldehyde fiber in the first carded web may be present at levels of greater than or equal to 10% (wt.), and the first carded web may also comprise, e.g. 5-25% (wt.) of aramid fiber in combination with 95-75% (wt.) of a viscose fiber containing silicic acid or 5-25% (wt.) of melamine/formaldehyde fiber in combination with 95-25% (wt.) of a viscose fiber containing silicic acid.

In a seventh embodiment the present invention is directed at a fire blocking non-woven textile structure comprising a first carded web including an aramide and/or melamine/formaldehyde fiber and a second carded web comprising a blend of a binder fiber and a polyester fiber, wherein said first carded web contacts said second carded web of said blend. The aramid and/or melamine/formaldehyde fiber in the first carded web may be present at levels of greater than or equal to 10% (wt.), and the first carded web may also comprise, e.g. 5-25% (wt.) of aramid fiber in combination with 95-75% (wt.) of a viscose fiber containing silicic acid or 5-25% (wt.) of melamine/formaldehyde fiber in combination with 95-25% (wt.) of a viscose fiber containing silicic acid. Optionally, the second carded web may further include natural fibers (fibers made from animals, vegetables or minerals, such as wool, cotton, silk, etc) and/or polyacrylonitrile copolymer with a halogen comonomer.

In another exemplary embodiment the present invention relates to a fire blocking non-woven textile comprising a first carded web providing a first layer of char-forming fibers comprising aramid and/or melamine/formaldehyde fiber and a second carded web providing a second layer of oxygen-depleting fibers comprising a blend of polyacrylonitrile copolymer with a halogen comonomer and a polyester polymer. The char-forming fibers of the first layer are present in the second layer at a level of 0-5.0% by weight and the oxygen-depleting fibers of the second layer are present in the first layer at a level of 0 to 5.0% by weight Such non-woven textile may have a maximum thickness of 3.0 mm and when applied to a mattress, according to 16 CFR 1633, will indicate a peak heat release rate of less than 200 kW within 30 minutes of testing and the total energy released of no more than 15 MJ for the first 10 minutes of testing. The first and second carded webs may be needle-punched or thermally bonded.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION OF THE PREFERRED EMBODIMENTS

Figure 1:
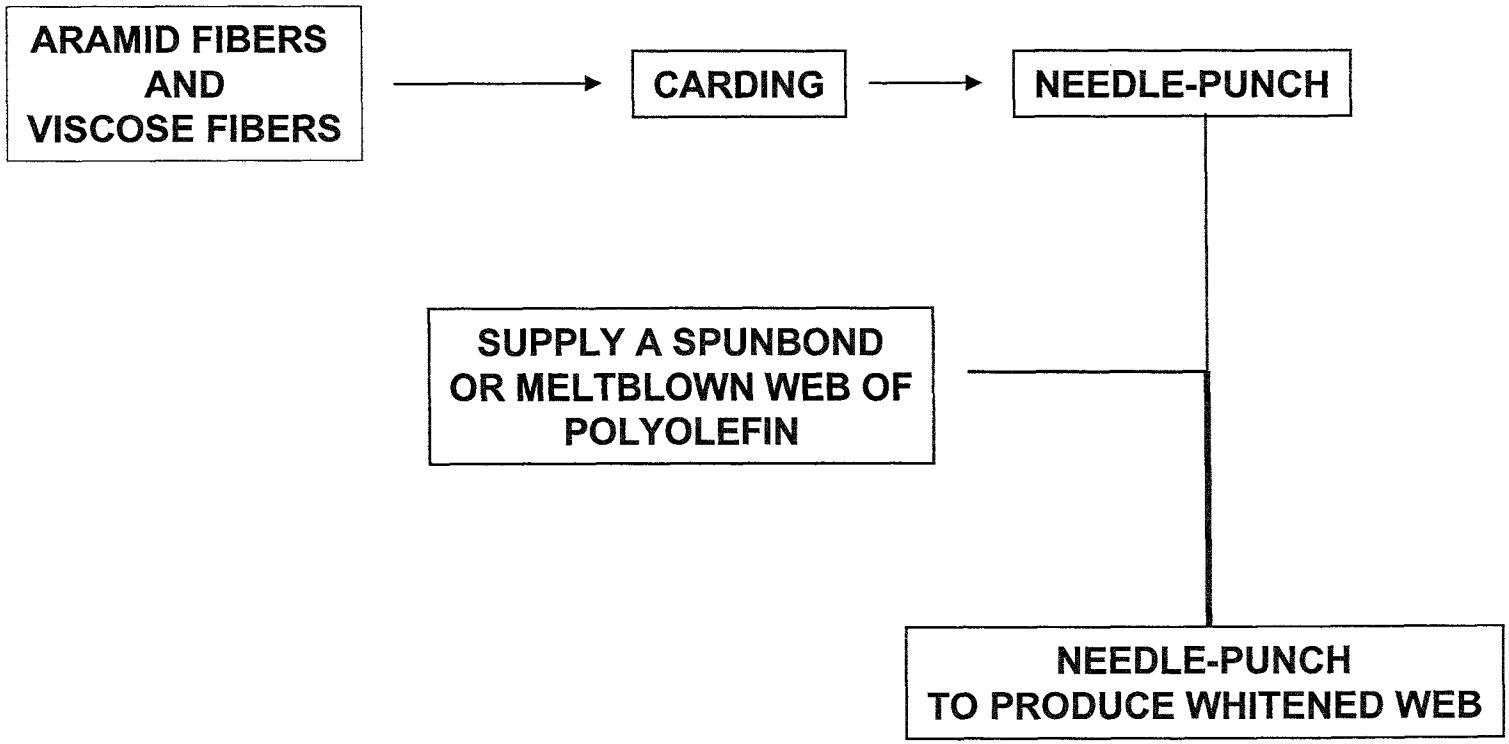
FIG. 1 is a flow-chart illustrating an embodiment of the invention for forming a needle-punched fire-blocking material of the present invention.

In the first embodiment, the fire resistant non-woven material of the present invention, which can be used as a protective liner material, is preferably manufactured from a needle-punched combination of modacrylic fiber with a second fiber component which may comprise a viscose fiber containing silicic acid and or a melamine/formaldehyde polymer. Optionally, and as described in more detail below, an inorganic filler such as vermiculate may be included as a coating. Other inorganic fillers include those selected from the group consisting of graphite, fumed silica or silica dioxide, or titanium dioxide, and mixtures thereof.

It should be noted that at least one factor contributing to the performance of this first embodiment, as a unique fire resistant non-woven material, is the modacrylic fiber. When the modacrylic is activated by heat, it apparently assists in the displacement of oxygen thereby reducing heat release and burn rate. Furthermore, the vermiculate coating may then serve to disperse the heat across the needlepunch fabric. However, the invention herein is not limited to any particular theorized functionality of the individual components and relies upon the various combinations that are ultimately described in the appended claims.

The modacrylic fiber is preferably based upon a polyacrylonitrile copolymer with a halogen containing comonomer, and the halogen containing comonomer is preferably poly (vinyl chloride) or poly(vinylidine chloride). A preferred modacrylic fiber is available form Kaneka Corporation, under the tradename Kanecaron™ Protex. In a most preferred embodiment, the modacrylic employed herein is sold under the tradename Kanecaron™ Protex PBX, at a specific gravity of 1.45-1.60 with a fiber denier of 2.2 dtex×38 mm. Protex PBX is described as having the following chemical components: acrylonitrile, vinylidine chloride copolymer, antimony oxide. A preferred viscose fiber containing silicic acid is sold under the tradename Visil™ available from Sateri Oy Inc. The Visil fiber is type AP 33 3.5 dtex×50 mm. It is composed of 65-75% regenerated cellulose, 25-35% silicic acid, and 2-5% aluminum hydroxide. A preferred melamine/formaldehyde fiber component is sold under the tradename Basofil™, available from McKinnon-Land-Moran, LLC.

Preferably, the non-woven material will also have a basis weight of 100-500 g/m$^2$, including all increments therebetween at 1 g/m$^2$ variation.

The above referenced fire blocking non-woven textile therefore may preferably contain the modacrylic polymer component (e.g., polyacrylonitrile copolymer with poly(vinylidine chloride)) at levels of about 30-80% (wt.), and correspondingly, the second fiber component which supports the modacrylic component may be present at about 20-70% (wt.). In a particularly preferred embodiment, the modacrylic component is present at about 80% (wt.) and the second fiber component is preferably a viscose fiber containing silicic acid and/or a melamine/formaldehyde polymer which is present at about 20% (wt.). In the context of all of these preferred ranges, it should be understood that within the broad scope of this invention, all increments therebetween are included, at 1% (wt) variation.

While not being bound by any particular theory, it has been observed that in the context of the above needle punched non-woven structure, the second fiber component serves to support the first fiber component during burning. By "support" it is meant that the second fiber maintains the first fiber component in place thereby reducing the tendency of the first fiber component to undergo shrinkage during burning, which shrinkage will sacrifice considerably the fire blocking performance. Accordingly, the combination of the first and second fiber components, through the needle punching operation, allows for the development of an relatively inexpensive fire blocking composition which can be readily applied as a fire blocking fabric liner under upholstery fabric and mattress ticking, thereby protecting the more flammable interior components of such products from igniting and participating in the burning process.

In addition, and again, without being bound by any particular theory of operation, it is also believed that the selective use of the modacrylic fibers herein, that preferably rely upon a copolymer of polyacrylonitrile and a poly(vinylidine chloride) copolymer structure, releases hydrochloric gas during the burning process. It is believed that the hydrochloric gas then assists in controlling the burn rate, providing another overall synergistic feature with respect to the above disclosed strategic selection of the individual components. Also, when combustion temperatures exceed 600° F., oxyhalides are formed which take up the free radicals formed in the vapor phase.

Furthermore, as noted above, it is preferable that the above non-woven include an inorganic filler, e.g. vermiculite as a coating or saturant component. Vermiculate is reference to one of the mica groups that are used as granular fillers, and comprise a crystalline layer silicate material. However, some of the silicon atoms are replaced with aluminum, producing a negative charge that is neutralized by the interlayer cations, mostly magnesium. The vermiculite particles are of a planer structure consisting of platelets that have a minimum 400:1 xy plane to z plane ratio. Preferably, the level of vermiculate herein, as a coating in the non-woven, is about 20-40 g/m$^2$, including all increments therebetween at 1.0 g/m$^2$ variation.

In accordance with the above embodiment, the fire blocking non-woven material is preferably of a thickness of: 1.5-25 mm, including all increments therebetween at 1.0 mm variation.

In a second preferred embodiment, the above non-woven textile is further modified, in the sense that the concentration of the first and second fiber components are reduced in favor of the use of a binder polymer fiber. Such binder polymer fiber has the capability to melt bond with the first and second fiber components. The preferred binder fiber is 4d×2" from either Nan Ya or Sam Yang in Korea with the outer layer having a melting point of 150° C. which melting point is lower than the melting point of the inner layer of this particular binder fiber material. Furthermore, in this embodiment the first component modacrylic fiber is first blended with the second fiber component (viscose fiber containing silicic acid and/or melamine/formaldehyde polymer) as well as the bicomponent polymer fiber noted above. The three fibers are blended together, formed into a web which is then vertically lapped and then bonded in a hot air oven as the final process. The binder fiber outer layer melts and flows onto the other fibers which bonds the structure together.

Elaborating upon the above, and in the broad context of the present invention, the binder fibers of the present invention may include one or plurality of polymer components. In addition, the binder fiber may be in the form of a sheath/core, side by side, or monofilament configuration.

In accordance with the above, the modacrylic fiber component is present at a level of about 50-70% (wt.), the second fiber component is present at a level of about 10-20% (wt.) and the binder fiber is present at a level of about 10-30% (wt.). Again, as noted above, it should be understood that in the context of the present invention, all increments therebetween are included at 1% (wt) variation. Furthermore, such composition preferably is prepared at a basis weight of 100-500 g/m$^2$, and at all 1.0 g/m$^2$ increments.

As noted above, the invention herein is further directed and has been expanded to include a fire blocking non-woven needle-punched textile structure comprising the following fiber components: 1. a first fiber component containing polyacrylonitrile copolymer with a halogen containing monomer; 2. a second fiber component, preferably a viscose fiber containing silicic acid and/or a regenerated cellulose fiber prepared from wood pulp (e.g. lyocell fiber); and 3. a third fiber component comprising an aramid fiber or a polyester fiber.

Preferably, the aramid fiber is reference to an aromatic polyamide type fiber material, such as a poly (p-phenylene terephthalamide) made by E.I. DuPont de Nemours & Co. and sold as KEVLAR®. Preferably, the aramid fiber is present at a level of less than or equal to 60.0% wt., including all percentages and ranges therein. In addition, reference herein to a viscose fiber is general reference to a fiber produced by the viscose process in which cellulose is chemically converted into a compound for ultimate formation into a fiber material. Regenerated cellulose is general reference to cellulose that is first converted it into a form suitable for fiber preparation (e.g. xanthation) and regenerating the cellulose into fiber form.

In addition, preferably, the fiber denier of the fibers of such textile structure may be configured in the range of about 1-15 denier, including all increments and ranges therebetween. In addition, the basis weight of any such fire blocking textile structure may be in the range of about 100-350 g/m$^2$. In addition, optionally, one may employ a binder fiber which as noted herein, comprises one or a plurality of fiber components, in either a sheath/core, side-by-side or monofilament configuration.

Expanding on the above, it is worth noting that the preferred use of the lyocell fiber herein is broadly defined herein as one example of a synthetic fiber produced from cellulosic substances. Lyocell is reportedly obtained by placing raw cellulose in an amine oxide solvent, the solution is filtered, extruded into an aqueous bath of dilute amine oxide, and coagulated into fiber form. From a property perspective, lyocell is also described as being a relatively soft, strong and absorbent fiber, with excellent wet strength, that happens to be wrinkle resistance, dyable to a number of colors, simulating silk or suede, with good drapability.

Accordingly, in the context of the present invention, the first fiber component (polyacrylonitrile copolymer with halogen containing monomer) may be preferably present in an amount of 30-60% wt., the second fiber component (viscose fiber containing silicic acid such as Visil™ or Lyocell fiber) may be present in an amount of 20-50% wt., and the aramid fiber may be present in an amount of 10-20% wt. All percentage values and ranges therein are also contemplated in the context of the present invention. Some exemplary formulations may therefore be as follows:

EXAMPLE I

| | |
|---|---|
| PAN copolymer | 40% wt. (7.0 Denier) |
| Visil ™ | 40% wt. (4.5 Denier) |
| PET | 20% wt. (6.0 Denier) |

EXAMPLE II

| | |
|---|---|
| PAN copolymer | 40% wt. (7.0 Denier) |
| Lyocell fiber | 40% wt. (3.0 Denier) |
| PET | 20% wt. (6.0 Denier) |

In addition, as noted, the invention herein also recognizes that with respect to foam-containing articles, such as a mattress, sofa cushion or pillow, it is important to provide such products in a fashion where there is protection against the flammability characteristics of the foam contained within such products. On that note it can be appreciated that with respect to the federal standard 16CFR1633, the purpose of such test is to determine the burning behavior of mattresses by measuring specific fire-test responses when the mattress is subjected to a specified flaming ignition source under ventilated conditions. It is stated that a mattress is considered to have failed the requirements of the test procedure if any of the following criteria are exceeded: 1. a peak rate of heat release of 200 kW within 30 minutes and 2. a total heat release of 15 MJ in the first 10 minutes of the test.

Accordingly, it has been appreciated herein that given the fact that a foam-containing article such as a mattress, will have different burning characteristics either in the mattress vertical panel section or mattress horizontal panel section, one can selectively provide a fire-blocking non-woven needle punched cover structure which strategically provides more flame resistant characteristics to the vertical section of the mattress where burning tends to be a more serious problem. Accordingly, the invention herein provides a fire blocking non-woven needle-punched textile cover structure for a foam-containing article such as a mattress, wherein said mattress has a substantially vertical panel section and a substantially horizontal panel section, wherein said cover structure includes horizontal and vertical panel cover sections. The vertical cover section preferably comprises a first fiber component containing polyacrylonitrile copolymer with a halogen containing monomer and a second fiber component comprising a viscose fiber containing silicic acid and a third fiber component comprising an aramid fiber. The vertical cover section may also include a first carded web including an aramid and/or melamine/formaldehyde fiber and a second carded web comprising a blend of polyacrylonitrile copolymer with a halogen comonomer and a polyester polymer, wherein said first carded web including aramid and/or melamine/formaldehyde fiber is needle punched with said second carded web of said blend The horizontal panel cover section comprises a first fiber component containing polyacrylonitrile copolymer with a halogen containing monomer and a second fiber component comprising a viscose fiber containing silicic acid and a third fiber component comprising a polyester fiber. Accordingly, by strategically locating, e.g., the aramid fiber to the vertical section of the mattress, compliance can be achieved with requirements of 16CFR1633, without, e.g., locating aramid fiber at every location of the flame blocking non-woven needle-punched mattress cover.

Furthermore, some mattress constructions can pass the test while covering the entire mattress with one or the other cover compositions noted above, which may be a function of the nature of the mattress foaming construction (e.g., amount/thickness of the foam).

In connection with the manufacture of needle-punched non-woven materials herein, containing aramid fiber, it can be noted that given the inherent yellow color of the aramid fiber, it has been found that certain levels of the aramid, in the non-woven, will cause the non-woven to similarly yellow, thereby providing an undesirable cosmetic effect for a mattress product. Accordingly, it has been found that such undesirable cosmetic feature can be addressed in the fire blocking non-woven structure, containing an aramid fiber, wherein the needle-punched web including the aramid fiber is needle-punched or otherwise attached to a spunbond, a melt blown web or spunbond/meltblown composite material. See, e.g, FIG. 1.

Those of skill in the art will recognize that a spunbond web material is general reference to spunlaid technology in which the filaments have been extruded, drawn and laid on a moving belt to form a web. Accordingly, a polymer suitable for the formation of spunbond material may be introduced into an extruder, output to a spinning die, and collected on a web laydown belt and calender bonded to form a web. In related fashion, a melt blown web material is general reference to a nonwoven web forming process that extrudes and draws molten polymer resin with heated, relatively high velocity air to form fine filaments. The filaments are cooled and collected as a web onto a moving belt. While similar to the spunbond process, the melt blown fibers tend to be finer and more generally measured in microns. Accordingly, melt blowing is another form of a spunlaid process.

Accordingly, the spunbond or meltblown materials suitable for needle punching or otherwise attaching to the aramid based non-wovens of the present invention preferably comprises a polyolefin or polyester based material. The objective then is to select that amount of spunbond or meltblown material for combining with the aramid based non-woven web to attenuate the yellow color that is typical for the aramid based web. Accordingly, by attaching a spunbond or melt blown to the aramid based non-woven web, the yellow color of the aramid based web is whitened to provide a more cosmetically pleasing cover for a mattress or other types of foam-containing articles.

In a related embodiment to the above, it has also been found that one can prepare a cosmetically pleasing fire-blocking cover by first supplying a carded web of an aramid based fiber, e.g., a carded web of aramid with a viscose fiber containing silicic acid (e.g., Visil™). Preferably, the amount of aramid fiber in this first carded web is at a level of equal to or greater than 10% (wt.), and preferably, in the range of 10-60% (wt.), including all levels and ranges therebetween. The corresponding amount of viscose fiber is preferably present at a level between 40-90% (wt.), and at all levels and ranges therebetween.

Figure 2:
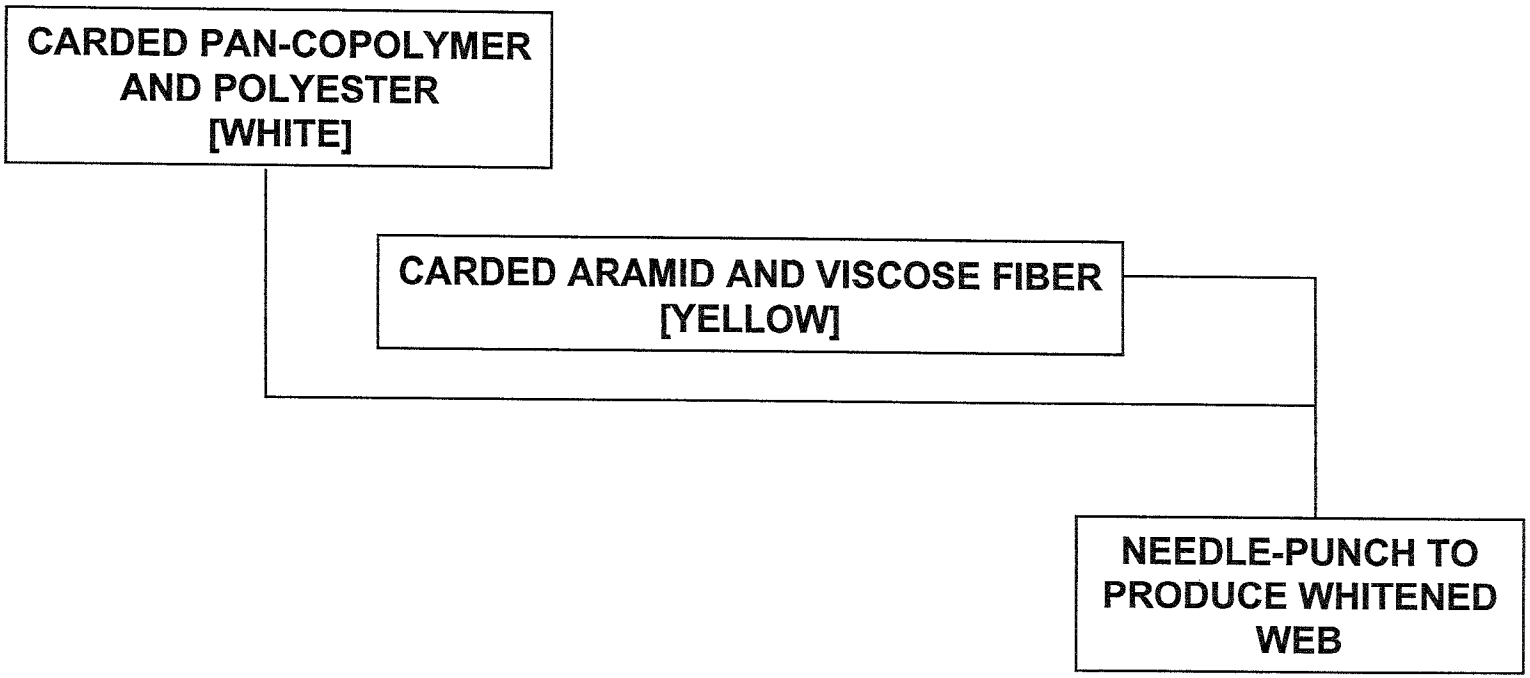
FIG. 2 is a flow-chart again illustrating an embodiment of the invention for forming a needle-punched fire-blocking material of the present invention.

The above is followed by supplying a second carded web comprising a polyacrylonitrile based composition, which composition may preferably include a blend of polyacrylonitrile copolymer containing a halogen comonomer with a polyester polymer such as PET. Preferably, in the case of such blend, the polyacrylonitrile copolymer containing a halogen commoner is present at a level of 70-30% (wt.) and the polyester is present at a level of 30-70% (wt.). The two carded webs may then be needle-punched under conditions wherein the needle-punching is controlled to the point wherein the yellow color of the aramid based carded web is whitened by the incorporation of the polyacrylonitrile web. A summary of the aforementioned process is illustrated in FIG. 2. In addition, in such embodiment, optionally, one may further needle punch with a spunbond or meltblown web of polyolefin or polyester material.

In connection with the disclosure above of the "sixth embodiment" of the present invention in the section identified as the "summary", one of ordinary skill in the art would appreciate that the present disclosure relates to a fire blocking non-woven structure that includes one layer that may act as a char forming layer (not contaminated with oxygen-depleting fibers which may otherwise disturb char formation) and one layer that acts as a oxygen depleting layer, not contaminated with char forming fibers which would effectively have no value in such oxygen depleting layer. Reference to char forming layer may therefore be understood as a layer of fibers that are capable of forming a char which is relatively harder to ignite than the original polymer, and which is self-extinguishing and which may also provide resistance to thermal transport. Reference to an oxygen-depleting fiber or layer herein may be understood as that situation where the underlying material (e.g. polymeric fiber) is one that leads to the formation of a nonflammable or dense combustion product that will smother the flame by excluding oxygen around the polymer.

Expanding upon the above, the char forming layer is one whose composition of fibers that provides charring does not cross-over into the oxygen depletion layer, and vice versa. That is, for a given char forming layer, the fibers contributing to char formation are not present in the oxygen depleting layer by an amount greater than 5.0% by weight. Accordingly, it may be appreciated that the fibers contributing to char formation may be present in the oxygen depleting layer at a level of 0% by weight up to 5.0% by weight, including all values therein, in 0.1% by weight increments. Similarly, for a given oxygen depleting layer, the fibers contributing to oxygen depletion are not present in the char forming layer by an amount greater 5.0% by weight. Accordingly, it may be appreciated that the fibers contributing to oxygen depletion may be present in the char forming layer at a level of 0% by weight up to 5.0% by weight, including all values therein, in 0.1% by weight increments. It should now be appreciated that by separating the layers in such fashion one may provide a two-layer product that, as now discussed more fully below, is unexpectedly more effective in providing flammability protection as applied to a mattress product.

The char forming layer may specifically be sourced from the above referenced aramid material (aromatic polyamide) and the weight percent of aramid in the char forming layer may as noted be present at a level of 5% (wt.) to 25% (wt.). The char forming layer may also, as noted, include 95% (wt.) to 75% (wt.) of a viscose fiber containing silicic acid or 5% (wt.) to 25% (wt.) of melamine/formaldehyde fiber in combination with 95% (wt.) to 25% (wt.) of a viscose fiber containing silicic acid.

The oxygen depleting layer may contain polyacrylonitrile copolymer with a halogen comonomer and a polyester polymer. The polyacrylonitrile copolymer with a halogen comonomer may be present at a level of 50% (wt.) to 100% (wt.) and the polyester polymer may be correspondingly present at a level of 50% (wt.) to 0% (wt.).

The fiber blocking structure described above may include or consist of the two layer non-woven described above, containing the oxygen depleting layer and the char forming layer. However, it may be appreciated that in other examples, where at least one pair of an oxygen depleting layer and a char forming layer may be present, additional layers including both oxygen depleting fibers and char forming fibers may be present.

Additional fiber components, may be present in the char forming layer or oxygen depleting layer, provided the layers still provide their char forming or oxygen-depleting function. Such fibers may specifically include those fibers that may be relied upon to promote thermal bonding between the two layers, with the control of cross-over previously discussed. For example, the char forming layer and/or oxygen depleting layer may include polyester fiber, and in particular the polyester fiber may include co-polyester fibers, or fibers including more than one polyester polymer or polymer blend. For example, the co-polyester fibers may include bi-component fibers or multi-component fibers having, for example, sheath core, "island-in-the-sea" or pie arrangements.

The overall thickness of the above referenced two layer construction of a char forming layer and an oxygen depleting layer may be a combined maximum of up to 3 mm. Preferably, the two layer construction may have a thickness of between 1.5-2.5 mm. In such a manner one may have, e.g., a char-forming layer that has a thickness of 0.1 mm to 3.0 mm and the oxygen depleting layer may have a thickness of 0.1 mm to 3.0 mm, wherein the values may vary by 0.1 mm. For example, one may preferably have a char forming layer that has a thickness of 0.1 mm to 1.5 mm and one may preferably have an oxygen depleting layer that has a thickness of 0.1 mm to 1.5 mm.

The above two layer construction has been found to provide the remarkable result of satisfying 16 CFR 1633 mattress testing requirements, which went into effect on Jul. 1, 2007. Such standard requires that the mattress sets must not exceed a 200 kilowatts (kW) peak heat release rate within 30 minutes of the test and the total energy released must be no more than 15 megajoules (MJ) for the first 10 minutes of the test. The specific testing procedures are recited at 16 CFR 1633.7.

An initial consideration of the superior action that is now obtained by use of the two layer construction as compared to a control is as follows. A first non-woven was provided at the weight "X" that included in a single carded layer 7.5% by wt. aramide fiber, 42.5% by wt. VISIL fiber, 30% by weight modacrylic fiber (polyacrylonitrile with a halogenated comonomer) and 20% polyester fibers. A second non-woven was provided with separated layers of (0.5)(X), i.e. char forming layer containing 15% by wt. aramide and 85% by wt. VISIL and a second layer of (0.5)(X) of oxygen depleting fibers containing 60% by weight modacrylic and 40% polyester. The first non-woven with of a single layer (non-separated char forming fibers and oxygen depleting fibers) at the weight of 140 g/m$^2$ had a char strength of 1.1 lbs/50 mm. By comparison, the second non-woven at the total weight of 140 g/m$^2$ with each layer at 70 g/m$^2$ with the indicated separated layers had a char strength of 2.3 lbs/50 mm. As char strength is clearly an important indication of how well the product may perform in the mattress testing noted herein under 16 CFR 1633, these results identify a significant and unexpected improvement.

That is, it may be appreciated that char strength is at least one indication as to how the product will perform in mattress testing since once the mattress ticking and other possible layers in front of the layer have burned, the strength of the char may determine how well the mattress may stay enclosed. As the mattress may stay enclosed there will be less oxygen that may come in contact with the inner layers and the flow of oxygen to the inside of the mattress may then be restricted, and the mattress is more likely to comply with 16 CFR 1633 as well as other flammability requirements that may be applicable.

The two separated char-forming and oxygen depleting layers of the textile structure may be needlepunched together, i.e., the fibers of the respective layers may be mechanically entangled together at the needled locations. In addition the two layers may be thermally bonded, in which case it has been found that it is preferable to utilize the bicomponent polyester fibers, as noted above, such as a bicomponent containing a core of poly(ethylene terephthalate) with a sheath of a copolymer of PET, where the sheath melts at a temperature of about 110 to 130° C. It may, therefore, be appreciated that with respect to the use of needlepunching, while the layers may be relatively distinct across the surface of the structures, the fibers associated with the char-forming layer and the fibers associated with the oxygen depleting layer may, as noted above, exhibit some degree of intermingling at the needling sites. Again, the crossover of the fibers within the char forming layer and/or the crossover of the fibers of the oxygen depleting layer, may be a maximum of 5.0% by weight.

In addition, it has been found that comparing the same composition of fibers, as between a needlepunched and thermally bonded two-layer non-woven (i.e. the needlepunched containing a non-activated PET/co-PET bicomponent for comparison purposes), there are two significant observations. First, the thermally bonded two-layer construction was observed to have a relatively lower overall energy throughput in a burn test. That is, in the burn test, when the flame hits the sample form one side and the surface temperature of the sample is measured from the other side with a photo-detector, the temperature recorded after 50 seconds of burning is lower with the thermally bonded two-layer construction as opposed to the needle-punched two-layer construction. However, the char strength of the needle-punched material was seen to be slightly higher than the two layer construction that is thermally bonded. This is reflected in the tables provided below, wherein both the thermally bonded two layer construction and the needle-punched construction comprise one layer of char forming fibers containing 65% VISIL, 15% Aramide and 20% BiCo and one layer of oxygen depleting fibers containing 60% Modacryl, 20% PES and 20% BiCo.

TABLE I

Energy Throughput In Burning Test of Thermally Bonded Two Layer Construction vs. Needlepunched Two Layer Construction

| Sample | Sample ID | Weight | Max. Temp |
|---|---|---|---|
| Needlepunched, thickness: 2.5 | 19.36 | 222 | 688 |
| | 21.56 | 232 | 641 |
| | 21.83 | 235 | 654 |
| Thermally bonded: Thickness: 1.7 mm; | 21.43 | 246 | 564 |
| Thermally bonded: Thickness: 2.5 mm; | 16.94 | 194 | 548 |
| Thermally bonded: Thickness: 5 mm | 21.61 | 248 | 528 |
| Thermally bonded: Thickness: 7.5 mm | 20.04 | 230 | 521 |
| Thermally bonded: Thickness: 11.5 mm | 17.68 | 203 | 501 |

Table II below illustrates the feature that the needlepunched two-layer construction of a char forming layer and oxygen depleting layer has much higher tensile strength in the char than thermally bonded two-layer construction.

TABLE II

Take out the sequence After Burn Testing

| Trial-# | g/sqm | mm | Max Temp | MD Tensile | Elongation | Composition/Description |
|---|---|---|---|---|---|---|
| 6 | 194.5 | 2.4 | 602 | 1.43 | 45.0 | Layer 1: 65% Visil, 15% Aramide, 20% BiCo. Layer 2: 60% Modacryl, 20% PES, 20% BiCo; thermally bonded |
| 8 | 196.9 | 2.3 | 616 | 1.30 | 39.4 | Same as above and thermally bonded. |
| 7 | 187.7 | 2.4 | 728 | 2.02 | 6.70 | Same composition as above but needlepunched |

TABLE II-continued

| Take out the sequence After Burn Testing | | | | | | |
|---|---|---|---|---|---|---|
| Trial-# | g/sqm | mm | Max Temp | MD Tensile | Elongation | Composition/Description |
| 9 | 193.3 | 2.5 | 729 | 2.64 | 21.00 | Same composition as above but needlepunched |

The two layer construction of a char-forming layer and oxygen-depleting layer was then evaluated according to 16 CFR 1633 testing protocols noted herein. Specifically, the 16 CFR 1633 test was applied to the most challenging mattress design, a latex of natural rubber (cis-polyisoprene) type mattress. Specifically, a 220 g/m$^2$ composition of 110 g/m$^2$ for each layer was provided with 85% VISIL and 15% aramide for the char-forming layer and the second layer at 110 g/m$^2$ with 60% modacrylic and 40% polyester, needlepunched to 2.5 mm thickness was found to completely protect a latex mattress of a height of 15". Accordingly, the char-forming layer (VISIL/aramid) was present at a thickness of about 1.25 mm and the oxygen depleting layer (modacrylic/polyester) was present at a thickness of 1.25 mm.

| 16CFR 1633 Tests | | | | |
|---|---|---|---|---|
| Description | Test 1 | Test 2 | Test 3 | Test 4 |
| Maximum rate of heat release (kW) | 28.36 | 31.44 | 34.00 | 36.17 |
| Total Heat Release in first 10 minutes (MJ) | 2.87 | 3.90 | 6.95 | 6.49 |

In connection with the above, it is again noted that the pass criteria for the 16 CFR 1633 are a maximum rate of heat release of 200 kW maximum (30 minutes) and a total heat release in the first 10 minutes of 15 MJ. As can be seen, the samples all satisfied such testing requirements for the latex based mattress.

It can be noted that the same two layer needle-punched composition noted above at a total weight of 140 g/m$^2$, with each layer at 70 g/m$^2$, was found to satisfy 16 CFR 1633 requirements for most non-latex type mattress.

With respect to the two layer construction herein of one carded layer containing char-forming fibers and one carded layer containing oxygen-depleting layers, such layers may be formed from the aforementioned polymeric fibers in a separate carding machine and may be laid down on belt in crossed layers. Then, the two layers may be conveniently fed into a needle loom for needle-punching. In addition, it has been found that after needle-punching, the two layers may be separated by hand and taken completely apart. Accordingly, this separates the action of the char forming fibers and oxygen depleting fibers which as noted, optimized char strength, and provides a relatively lightweight product that has a soft hand and which provides improved performance over those non-wovens which contain mixed fibers (i.e. mixed char-forming and oxygen-depleting fibers).

Furthermore, given the two layer construction herein, the aramid fibers of the char-forming layer may be visually seen (yellow in color) as existing nearly entirely within such layer and little or no aramid fiber may be seen in the oxygen-depleting layer. Accordingly, the two-layer construction herein may be readily provided with separate carding machines on the same needle-punching manufacturing line.

While the invention has been described in detail with reference to specific preferred embodiments, it will be appreciated that various changes and modifications can be made, and equivalents employed, without departing from the scope of the following claims.

What is claimed is:

1. A process for forming a two layer fire blocking non-woven textile comprising:

supplying a first carded web providing a first layer of char-forming fibers comprising 5-25% by weight aramid and 95%-75% by weight a viscose fiber containing silicic acid wherein said carded web has a basis weight of 100-350 g/m$^2$ and a thickness of 0.1 mm to 1.5 mm;

supplying a second carded web providing a second layer of oxygen-depleting fibers comprising a blend of polyacrylonitrile copolymer with a halogen comonomer and a polyester polymer wherein said polyacrylonitrile copolymer is present in said second carded web at a level of 70% to 30% by weight and said polyester copolymer is present at a level of 30% to 70% by weight and said second carded web has a basis weight of 100-350 g/m$^2$ and said second carded web has a thickness of 0.1 mm to 1.5 mm;

forming said two layer fire blocking non-woven textile by the method consisting of feeding said first and second carded web into a needle loom and needle-punching the entirety of said first carded web to said second carded web and forming said two-layer textile wherein said char-forming fibers of said first layer are present in said second layer at a level of 0-5.0% by weight and said oxygen-depleting fibers of said second layer being present in said first layer at a level of 0 to 5.0% by weight; and wherein said non-woven textile has a maximum thickness of 3.0 mm and when applied to a mattress, according to 16 CFR 1633, indicates a peak heat release rate of less than 200 kW within 30 minutes of testing and the total energy released of no more than 15 MJ for the first 10 minutes of testing.

2. The process of claim 1 wherein said first carded web has a basis weight of 110 g/m$^2$ and said second carded web as a basis weight of 110 g/m$^2$.

3. The process of claim 1 wherein said first carded web has a basis weight of 70 g/m$^2$ and said second carded web has a basis weight of 70 g/m$^2$.

4. The process of claim 2 wherein each carded web is present at a thickness of 1.25 mm.

5. The process of claim 2 wherein said two layer fire blocking non-woven textile is applied to a mattress of a latex of natural rubber.

6. The process of claim 2 wherein said two layer fire blocking non-woven textile has a thickness of 1.5 mm to 2.5 mm.

* * * * *